United States Patent [19]

Smith, Jr.

[11] 4,146,972

[45] Apr. 3, 1979

[54] CONTINUOUS WEB DRYING

[75] Inventor: Horace L. Smith, Jr., Richmond, Va.

[73] Assignee: Smitherm Industries, Inc., Richmond, Va.

[21] Appl. No.: 670,248

[22] Filed: Mar. 25, 1976

Related U.S. Application Data

[63] Continuation-in-part of Ser. No. 622,617, Oct. 15, 1975, abandoned.

[51] Int. Cl.[2] ..... F26B 3/24

[52] U.S. Cl. ..... 34/41; 34/48; 34/66; 34/119; 34/152; 165/65; 165/90

[58] Field of Search ..... 34/111, 116, 123, 152, 34/124, 41, 48, 62, 66, 119; 165/89, 90, 65, 107

[56] References Cited

U.S. PATENT DOCUMENTS

| | | | |
|---|---|---|---|
| 1,737,926 | 12/1929 | Ireland | 34/119 |
| 1,898,041 | 2/1933 | Feeney | 34/111 |
| 3,236,292 | 2/1966 | Smith | 165/11 |
| 3,289,315 | 12/1966 | Smith, Jr. | 34/92 |
| 3,793,741 | 2/1974 | Smith, Jr. | 34/48 |
| 3,864,842 | 2/1975 | Sawyer | 34/152 |

*Primary Examiner*—John J. Camby
*Assistant Examiner*—Larry I. Schwartz
*Attorney, Agent, or Firm*—Strauch, Nolan, Neale, Nies & Kurz

[57] ABSTRACT

Methods of and installations for drying continuous webs of materials such as paper in which the web contacts rotating dryers heated by circulating a heat transfer liquid through them. Rotary dryers for such installations; and methods for upgrading the performance of conventional installations employing rotary dryers and for upgrading the performance of conventional rotary dryers.

2 Claims, 13 Drawing Figures

CONTINUOUS WEB DRYING

This application is a continuation-in-part of application Ser. No. 622,617 filed Oct. 15, 1975 now abandoned.

The present invention relates in one aspect to novel, improved methods of and apparatus for drying continuous webs of paper and other materials.

In another aspect the present invention relates to methods for upgrading the performance of those conventional installations in which continuous webs are dried by passing them over steam heated, rotary dryers.

And, in still other aspects, the present invention relates to the provision of novel, improved rotary dryers, to methods for fabricating rotary dryers, and to methods for upgrading the performance of conventional, steam heated, rotary dryers.

The term "paper" is used herein in the same generic sense as it is in the papermaking industry. Products embraced by this term include: newsprint; uncoated, ground wood paper; coated printing and converting paper; uncoated book paper; writing and related papers; bleached bristols; unbleached kraft packaging and industrial converting papers; other packaging and industrial converting papers; special industrial papers; tissue paper; unbleached kraft and industrial converting paperboard; bleached packaging and industrial converting paperboard; semichemical paperboard; combination furnish paperboard; wet machine board; and construction paper and board.

Paper is produced in the United States at an annual rate exceeding 61,000,000 tons. This paper is dried almost exclusively with steam heated, rotary dryers.

The dryer section of a modern paper machine has 50 to 60 rotary dryers each six feet in diameter and 30 feet long and weighing over eight tons. A dryer section of this character costs many million dollars ($18,000 per inch of drying width in 1972). At current fuel prices the cost of operating a dryer section of this character is approximately $13.50 per ton of paper.

Dryer installations of the character just described have two major disadvantages. The first is that they are not very efficient because of high back pressures, pressure losses, radiation through the ends of the dryers, etc.

A second disadvantage of steam heated rotary dryers is that the web is not dried uniformly across its width. Because of this much of the web must be overdried to insure that all of the material is adequately dried. Otherwise, blackening may occur in the region of the wet streaks; and it can become difficult to build an acceptable reel.

Variations in moisture content can also adversely effect important physical characteristics of the final product such as fold, stretch, and tear to a significant extent. Also, moisture profile variations have an adverse effect on dimensional characteristics such as curl and cockling, all as discussed in detail in Cross-Machine Moisture Uniformity — Its Importance and Control, PAPER TRADE JOURNAL, Mar. 30, 1970, pp. 67–73. Furthermore, converting difficulties are commonly experienced in processing overdried paper to its final form.

To put this problem in its proper perspective, an article in the Oct. 5, 1970, issue of the PAPER TRADE JOURNAL (pp. 41–43) points out the capacity of existing installations could be automatically increased by 15–20 percent if uneven drying could be eliminated.

I have now discovered that the drawbacks of a conventional installation employing steam heated, rotary dryers can be eliminated by replacing those dryers with liquid heated, rotary dryers of a character which I identify by the term "equitemp dryers".

Equitemp dryers are disclosed in my prior U.S. Pat. Nos. 3,177,932 issued Apr. 13, 1965, for DRUM TYPE HEAT TRANSFER APPARATUS; 3,181,605 issued May 4, 1965, for UNIFORMLY HEATED ROTARY DRUM; and 3,228,462 issued Jan. 11, 1966, for HEAT EXCHANGE APPARATUS.

Equitemp rotary dryers have concentric inner and outer shells between which a heat exchange liquid is circulated to heat the outer shell. Typically, the heat exchange liquid is circulated in counterflow fashion through internested, labyrinthic flow channels defined by partitions between the inner and outer shells.

A variety of suitable heat exchange liquids are available. Among these is Aroclor 1248, a chlorinated biphenyl produced by Monsanto Chemical Company. Aroclor 1248 may be heated to temperatures up to on the order of 550°–570° F. without exceeding a permissive rate of decomposition. In that temperature range Aroclor 1248 has a decomposition rate of less than 0.001 percent per hour of system operation.

Systems for heating the heat exchange liquids which have efficiencies comparable to those of modern steam generators are available. One heating system for such liquids is described in my U.S. Pat. No. 3,236,299 issued Feb. 22, 1966, for HIGH TEMPERATURE HEATING APPARATUS.

Probably the most important advantage of substituting equitemp dryers for those of the steam heated type in paper making and similar operations is a drastic reduction in the cost of making the product. Fuel is the largest item in the cost of making such products, and the present invention has the potential for cutting fuel costs in half.

Further cost advantages and increases in product quality can be realized because of another potential of the present invention—an improvement in the moisture profile of the product.

One of the major contributors to an uneven moisture profile in a conventional installation is condensate in the dryers. Despite the elaborate systems devised for siphoning out this condensate, variations in the thickness of the film which remains can produce surface temperature variations of 30°–40° F. This is enough to cause the moisture content of the dried product to vary as much as 100 percent or more from the optimum level.

Furthermore, where warranted, unevenness in moisture profiles can be further reduced by combining with the equitemp dryers a radiant moisture profile correction unit of the character shown in my U.S. Pat. Nos. 3,791,049 and 3,793,741 issued Feb. 12 and 26, 1974, for DRYING METHODS WITH MOISTURE PROFILE CONTROL AND DRYING APPARATUS WITH MOISTURE PROFILE CONTROL.

Again, this is a novel concept which is especially attractive from the economic viewpoint. Radiant units of the type I contemplate are inexpensive. Furthermore, they can be operated on the same heat transfer liquid as the rotary dryers, minimizing the cost of supplying energy to the moisture profile unit.

Also, it is practical to locate the profile correction unit virtually where desired in the dryer section. As discussed in the paper beginning on page 67 of the Mar.

30, 1970, issue of PAPER TRADE JOURNAL, such flexibility is of considerable importance.

Still another advantage of the present invention is that the dryers can be operated at temperatures above the practical maximum for steam heated dryers. Unlike steam, increases in the temperature of the heat exchange media I employ do not produce pressure increases. Accordingly, temperatures well above the 360°-370° F. limit to which steam is limited by the pressure the system must withstand can readily be employed.

The importance of this advantage is manifest. The availability of higher surface temperatures provides an increase in drying capacity and a corresponding reduction in drying costs.

Rotary dryers in accord with the present invention also have the advantage that they have the same configuration as, and can be dimensioned to match, the conventional, steam heated, rotary dryers they replace. Consequently, existing felts, ventilating systems, dryer drives, and the other ancillary equipment of existing systems can be used with minimal alteration.

Equitemp dryer installations employing the principles of the present invention may be constructed as such. In another important aspect of the present invention, however, such installations are provided by conversion of dryer sections of the conventional, steam heated type.

Because the replacement dryers are so much more efficient than those for which they are substituted, there will typically be a considerably smaller number of dryers in an upgraded or converted installation. This, too, has significant advantages.

One is that a considerable reduction in the energy consumed in driving the dryers may be obtained. That this is significant is apparent when it is realized that several thousand horsepower are consumed in driving the dryers of a modern papermaking machine.

In addition, considerable floorspace can be freed for other uses. Broke removal and threading of the dryer section are simplified, and maintenance costs are decreased by the simplification of the dryer section.

This novel conversion can advantageously be carried out by salvaging the shells of existing dryers and replacing their internal components with the inner shell and partitions needed to form flow channels for the heat exchange liquid. Typically, these will be incorporated in an assembly with end members for the dryer and axles for rotatably supporting it to facilitate their installation in the reclaimed shell.

This novel conversion of steam heated, rotary dryers to equitemp dryers is very attractive from the economic viewpoint because the bulk of the cost of a rotary dryer is in the shell. This component is typically made of 1.125-1.50 inch thick cast iron, and it must be fabricated to astonishingly close tolerances. Almost perfect balance is required in view of the 3000 feet per minute and higher surface speeds at which such dryers operate. Also, accuracy in the dimensions of the external surface is necessary to avoid the formation of wet streaks in the web being dried; and a high surface finish is necessary to keep fibers from sticking to the dryer.

Steam heated dryers can be converted by the technique described above to virtually any type of equitemp construction desired—those disclosed in my previously issued, above-identified patents, for example.

However, I have now invented a new and novel equitemp dryer construction and a method of assembly which facilitates the installation of the remaining components in the outer dryer shell and which increases the manufacturing tolerances these components may have. This makes the conversion of a steam heated, rotary dryer to one of the equitemp type even more attractive from the economic viewpoint.

In my novel, improved, equitemp dryer construction, the outer parts of the longitudinally extending, flow channel forming partitions are flexible and springlike and dimensioned to have an interference fit with the outer shell. This allows them to flex laterally, facilitating installation of the inner shell and partition assembly. They then tend to restore to their original shapes, producing tight fits between the partitions and the inner surface of the outer shell.

In the installation process the assembly of inner shell and partition members is rotated as it is slid into the outer shell. Because of their flexibility, the partitions offer little resistance to this spiral pattern of movement even though there is an interference fit between the partitions and the outer shell. Consequently, installation in a manner which will produce a tight partition-to-outer shell fit is a comparatively simple and correspondingly inexpensive process.

That a tight fit between the outer shell and the channel forming partitions can be obtained is an important advantage of the novel construction just described. This minimizes leakage of the heat exchange liquid from one channel to another, reducing variations in surface temperature and promoting uniform drying.

In the just described and other equitemp dryers separate heat transfer liquid circulation systems which span different portions of the outer shell can be readily provided. By circulating the heat transfer liquid through these systems at different rates and/or temperatures, various lateral portions of the dryers can be maintained at different surface temperatures. This affords yet another control over reel moisture profiles.

The technique just described is particularly useful in those modern, thirty foot and wider paper machines. In dryers of this width the moisture content of the air adjacent the central portion of the dryer typically approaches saturation; but the air at the ends of the dryer has a much lower moisture content for reasons elucidated in Lee, Moisture and Temperature Profiles Across a Paper Machine, TAPPI, August 1966, pages 107A and 108A, for example. By heating the central regions of the dryer shell to a higher temperature than the end regions, the drying rate in the central regions can be increased, offsetting the effect of the varying moisture content of the air on the reel moisture profile of the product being dried.

Advantage can of course be taken of the present invention without relying exclusively on the use of equitemp dryers. For example, in upgrading the performance of an existing installation, it may prove advantageous to replace the steam heated dryers in only one (or less than all) of the dryer sections with equitemp dryers.

Installations appearing at first blush to resemble those described above are disclosed in my issued U.S. Pat. No. 3,289,315 dated Dec. 6, 1966, and entitled DRYING ROLLS UTILIZING BELTS TRANSPARENT TO INFRARED RADIATION. That patent discloses a multiple roll dryer section and indicates that the dryers in it can be of the equitemp type.

However, there is nothing in the foregoing patent to suggest that equitemp dryers have any utility in multidryer sections except in conjunction with external radiant heaters and radiation transparent felts. Nor is there any disclosure in my issued patent suggesting that anything would be gained by replacing existing, steam heated, rotary dryers of conventional dryer sections with dryers of the equitemp type. Nor is there any suggestion of using components salvaged from the existing dryers in making the conversion, of employing equitemp construction for the felt dryers of multicylinder dryer sections, or of other of the novel features described herein.

My issued U.S. Pat. No. 3,236,292 discussed above suggests that the heating systems disclosed therein can be used to control the operation of equitemp dryers. However, there is no suggestion that the foregoing system could be utilized to control the dryers in a multicylinder dryer section, let alone how this would be done. The foregoing patent, moreover, obviously has nothing to do with the conversion of existing dryer sections; and it discloses none of the various novel features such as equitemp felt drying, etc.

It will be obvious to the reader from the foregoing that one important and primary object of the present invention resides in the provision of novel, improved methods of and apparatus for drying continuous webs of paper and the like.

Another important and primary object of the invention resides in the provision of novel, improved techniques for upgrading the performance of dryer sections employing conventional, steam heated dryers.

A related, also important and primary object of the invention is the provision of novel, improved techniques for converting steam heated, rotary dryers to dryers of the equitemp type.

Yet another important object of the invention resides in the provision of novel, improved dryers of the rotary, equitemp type.

Other important but more specific objects of the invention reside in the provision of methods and installations for drying continuous webs:

(1) which are capable of producing a substantial savings in fuel costs;

(2) which have the potential for improving the reel moisture content of the product, thereby increasing the quality of the product and making the drying process more profitable.

Another important but more specific object of the invention resides in the provision of methods of converting existing installations into plants capable of meeting the just-enumerated goals.

A related and also important object is the provision of upgrading or conversion techniques in accord with the preceding object which permit the conversion to be made at an economically attractive price.

Yet another important but more specific object of the invention resides in the provision of rotary, equitemp dryers which are improvements on those disclosed in my already issued patents.

Further important, but still more specific, objects of my invention reside in the provision of dryers as described in the preceding object:

(1) which have uniform surface temperatures;

(2) in which, in conjunction with the preceding object, flow of the heat transfer liquid between adjacent channels is minimized;

(3) which are relatively economical to construct;

(4) which can be heated to substantially higher surface temperatures than conventional, steam heated, rotary dryers;

(5) which can be operated in a manner compensating for variations in the moisture content of the ambient air across the span of the dryer;

(6) in which the surface temperature can be varied in a controlled manner across the span of the dryer;

(7) which, in conjunction with the preceding object, have independent flow systems in which a heat transfer liquid can be circulated at different temperatures and/or rates that span different lateral regions of the dryer; and (8) which have various combinations of the foregoing attributes.

A still further and related object of the present invention resides in the provision of novel techniques for assembling equitemp dryers which are economical and can, moreover, be employed to convert conventional, steam heated rotary dryers to dryers of the equitemp type.

Still other important objects and additional advantages and novel features of my invention will become apparent from the appended claims and from the ensuing detailed description and discussion of the invention taken in conjunction with the accompanying drawing in which:

Figure 1:
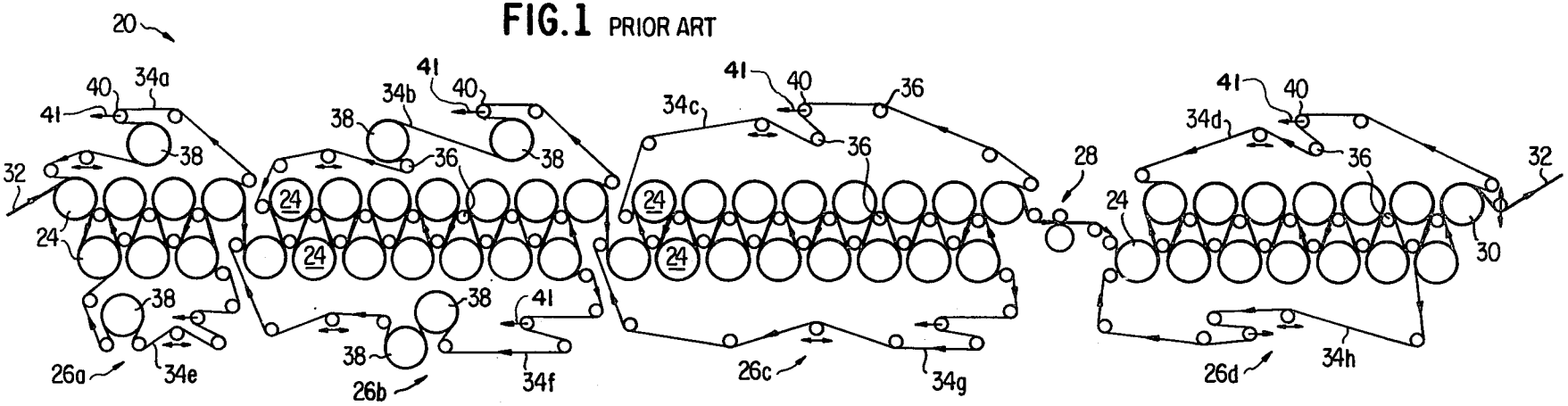
FIG. 1 PRIOR ART
FIG. 1 is a schematic side view of a paper making machine having a conventional dryer section in which water is evaporated from the paper by passing it over steam heated, rotary dryers.
Figure 2:
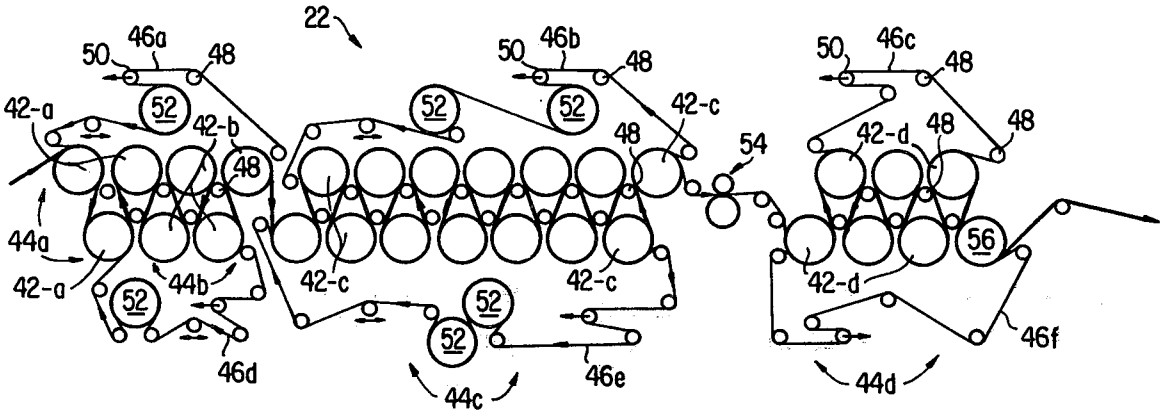
FIG. 2 is a similar view of a dryer section in accord with the principles of the present invention which has a capacity comparable to that of the dryer section shown in FIG. 1.

Referring now to the drawing, FIG. 1 depicts a conventional newsprint dryer 20; and FIG. 2 illustrates a dryer 22 of comparable capacity but constructed in accord with the principles of the present invention;

Dryer 20 includes 50 steam heated, rotary paper dryers 24 in four sections 26*a–d;* a breaker stack 28; and a sweat roll 30 for moistening the web 32 of paper being dried before it proceeds to a calendar stack.

Felts 34*a–h* are trained around those peripheral surface portions of the paper dryers 24 contacted by web 32 by felt rolls 36. The felts hold the paper tightly against the dryers and thereby improve the rate of transfer of heat to the paper. Moisture picked up from the paper is removed from the felts in the first three sections 26*a–c* of dryer 20 by passing them over rotary, steam heated felt dryers 38. Felt stretchers 40 movable as indicated by arrows 41 tension the felts.

In a typical installation the paper dryers 24 will be six feet in diameter and 30 feet long as discussed above. The paper moves through the dryer section at a speed of 3000 feet/minute or higher and remains in the dryer section for 15 seconds or less.

The novel dryer 22 shown in FIG. 2 differs from that just described in that it has liquid heated, rotary paper dryers 42. There are only 27 dryers, and these are divided into four groups 44*a–d* in which the operating temperatures can be independently controlled to optimize the drying operation.

This novel dryer employs conventional felts 46*a–f*, felt rolls 48, and stretchers 50. The felt dryers 52 can advantageously be of equitemp construction, and they can be heated by the same heat transfer liquid as paper dryers 42.

Dryer 22 also has a conventional breaker stack 54 and a sweat roll 56.

The dryers 42 and 52 and sweat roll 56 are preferably of the construction shown in FIGS. 6–10 in which the dryer is identified by reference character 60.

Dryer 60 has an outer cylindrical shell 62 of heat conductive material such as cast iron and an inner cylindrical shell 64. The inner and outer shells are separated by longitudinally extending, radially oriented, partitions or dividers 66 and 68. These form passages which are connected by flow diverters 70 into internested, labyrinthine flow channels 72 and 74 (see FIG. 9). A liquid, heat transfer medium flows in opposite directions through the flow channels, effecting a substantially uniform distribution of heat to the external surface 76 of outer shell 62.

The heat exchange liquid flows to and is returned from the flow channels by a fluid supply and return system which includes hollow axles 78 and 80 extending axially from heads 82 and 84 at opposite ends of the dryer. Branch supply passages 85 in dryer head 82 connect a fluid supply passage 86 in axle 78 with flow channels 72 and 74. After circulating through these channels, the heat transfer medium flows into radially extending branch return passages 87 in dryer head 84. At their inner ends, the branch return passages communicate with a main return passage 88 in axle 80.

As thus far described, dryer 60 is constructed as shown in FIGS. 1–7 of my previously issued U.S. Pat. No. 3,228,462 which is hereby incorporated in this specification and which may be referred to by the reader for additional detail, if desired.

Dryer 60 differs from that disclosed in my earlier patent primarily in the construction of channel forming partitions 66 and 68.

Figure 7:
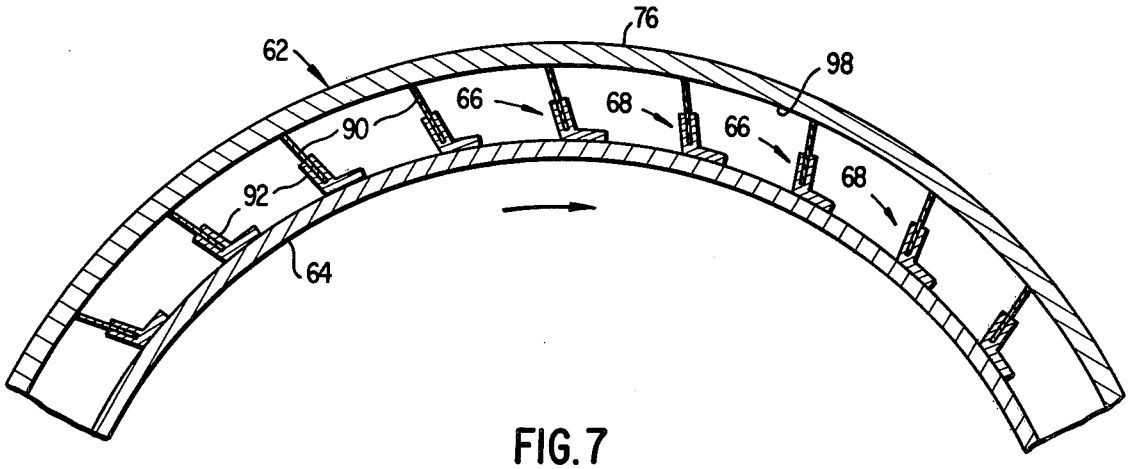
FIG. 7 is a partial section through the dryer of FIG. 6 taken substantially along line 7—7 of the latter Figure.
Figure 8:
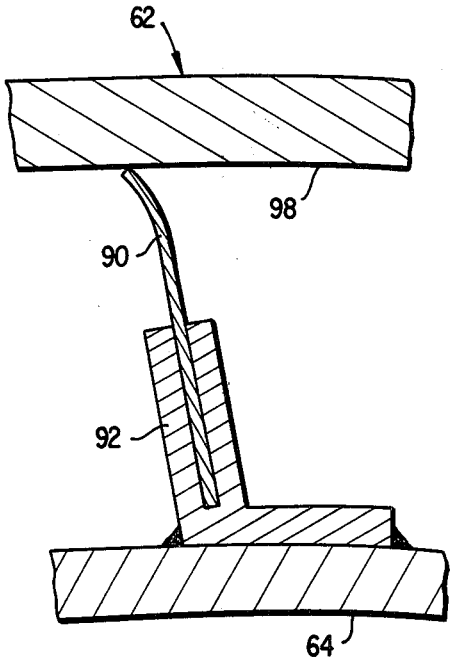
FIG. 8 is a fragment of FIG. 7 to an enlarged scale.

As shown in FIGS. 7 and 8, these partitions or dividers include laterally flexible, elongated members 90 mounted in generally L-sectioned brackets 92. The latter are fixed to the inner shell 64 of the dryer.

This novel divider construction is important because it facilitates assembly of the dryer, yet produces a tight seal between the dividers and the outer shell in the assembled dryer. As discussed previously, this is important in that it minimizes the flow of heat transfer liquid between channels, eliminating a major source of nonuniform surface temperatures.

Figure 10:
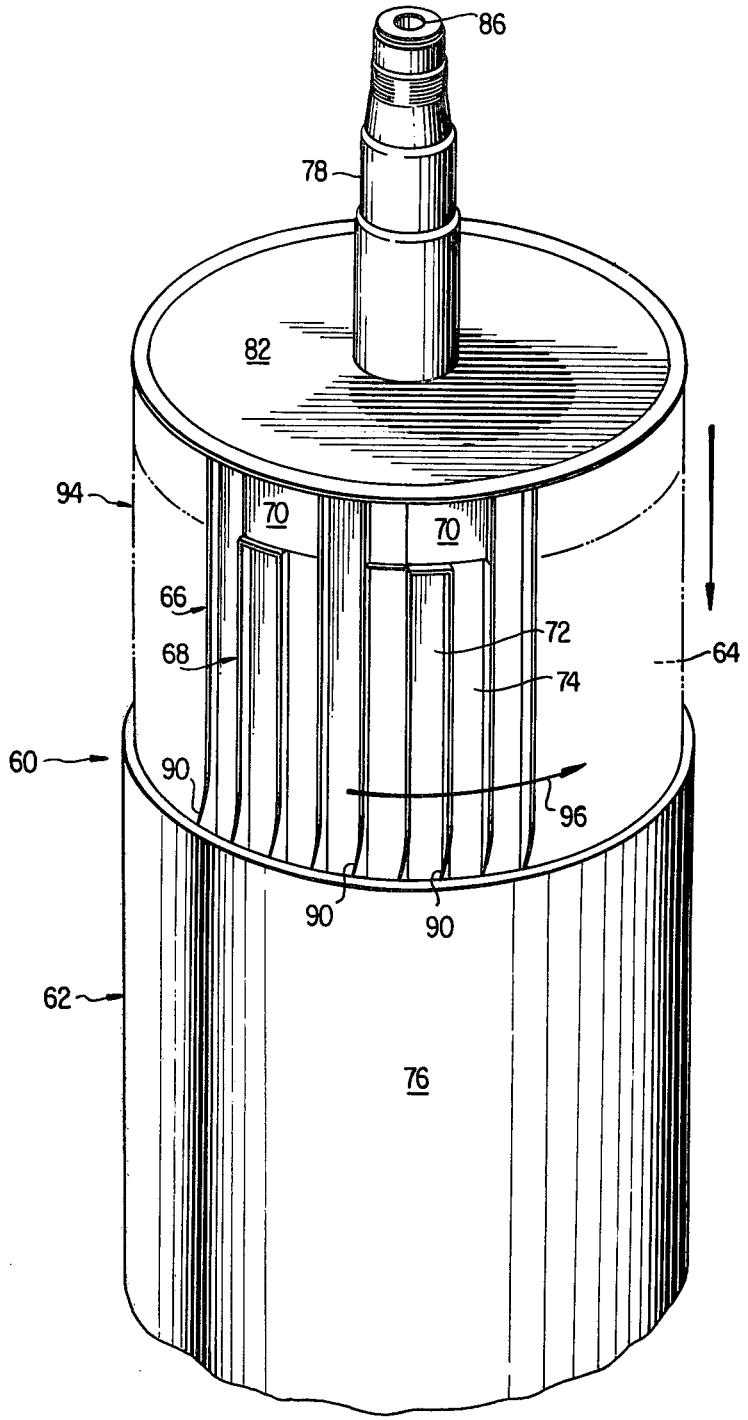
FIG. 10 is a pictorial illustration of the technique for assembling rotary, equitemp dryers I have invented.

In manufacturing a dryer as just described, the inner shell 64, heads 82 and 84, and channel dividers 66 and 68 plus the other internal components are assembled into a unitary system or cartridge 94. Then, as shown in FIG. 10, the assembly is simultaneously lowered or slid into outer shell 62 and rotated relative to the outer shell in the direction indicated by arrow 96. As shown pictorially in FIG. 10, this deflects the spring members 90 laterally, permitting the assembly to be easily installed.

Then, as shown in FIGS. 7 and 8, the spring members tend to restore to their original configurations, biasing them into essentially leaktight contact with the inner surface 98 of the outer shell.

Figure 11:
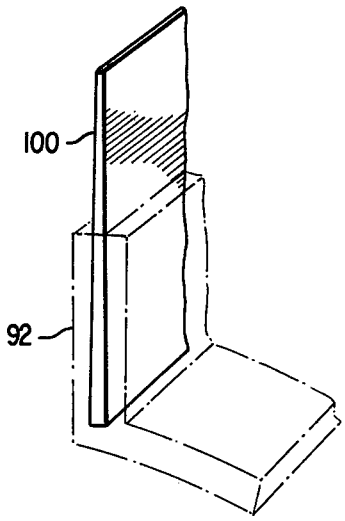
FIG. 11 is an end view of a second form of partition member for equitemp dryers employing the principles of the present invention.
Figure 9:
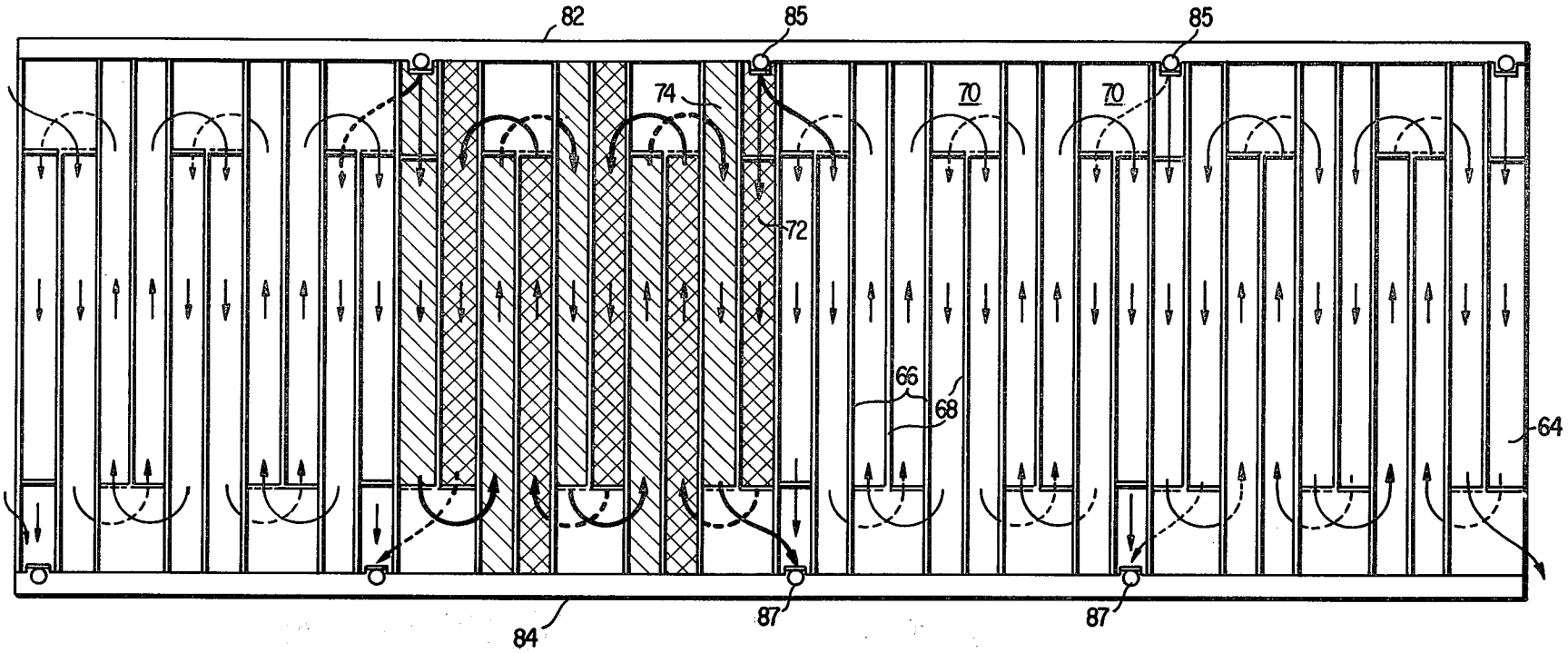
FIG. 9 is a development of the dryer of FIG. 6 showing the flow channels in the dryer in schematic form.

If desired, the spring action of the flexible divider components can be enhanced by employing strips with a tapered cross-section. The thicker part of the strip is fixed to the support component of the divider with the thinner, more flexible part adjacent the outer shell. A channel divider strip of this character is shown in FIG. 11 and identified by reference character 100.

The outer shell 62 of the novel liquid heated dryer 60 described above may have been made specifically for this purpose. Or, it may have been reclaimed from a conventional, steam heated dryer as discussed above.

Figure 3:
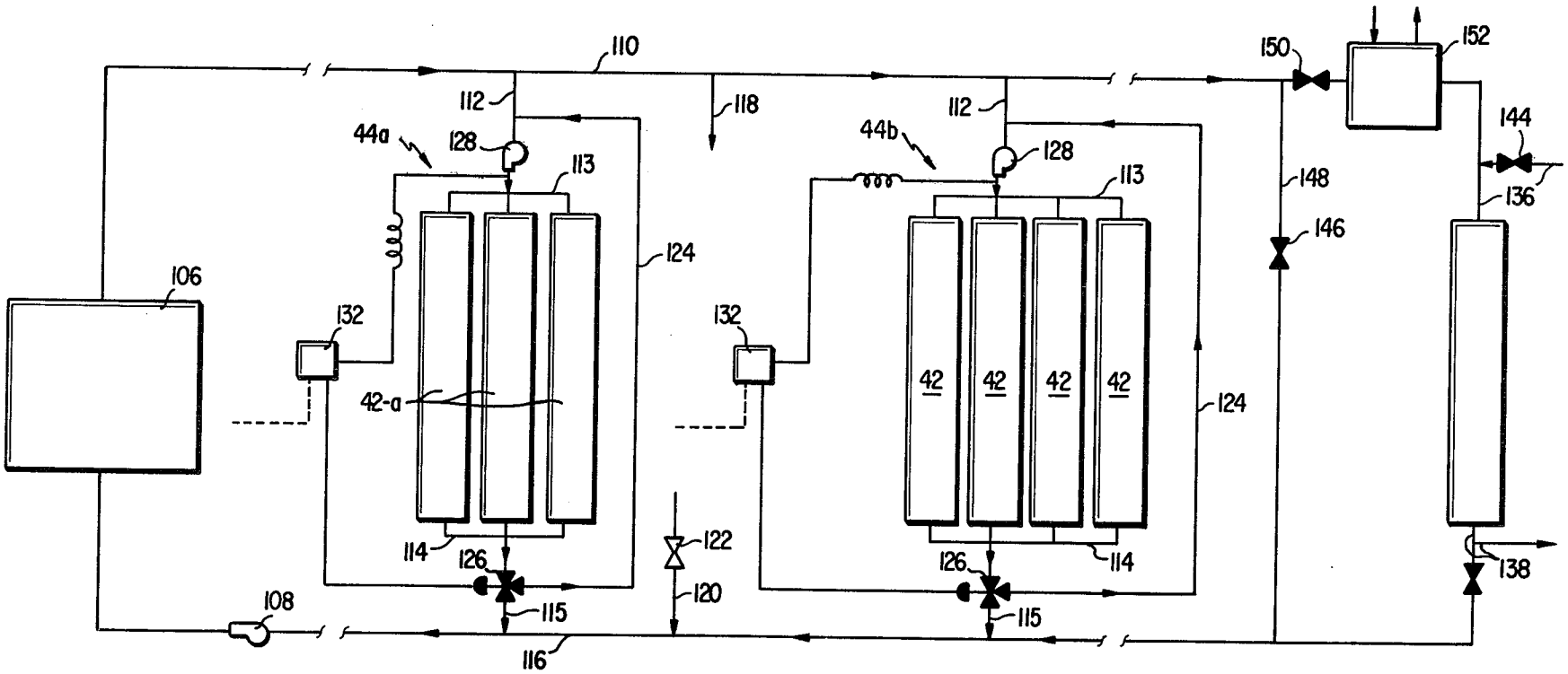
FIG. 3 is a partial schematic plan view of the dryer section shown in FIG. 2 with the illustrated dryer sections separated; it shows the system for heating a heat exchange liquid and circulating it to and through the rotary dryers in different sections of the installation.

Referring now to FIG. 3, the heat transfer liquid for the paper dryers 42 and felt dryers 52 is heated in a unit shown in block diagram form and designated by reference character 106. A number of suitable units have heretofore been proposed. One is disclosed in my above-referred-to U.S. Pat. No. 3,236,292.

A pump 108 circulates the heated liquid through main supply conduit 110, branch conduits 112, and supply manifold 113 to the dryers 42 in dryer section 22. After flowing through the dryers in the manner discussed above, the liquid is discharged through manifold 114 into branch conduits 115 and is recirculated through these and main return conduit 116 to heating unit 106.

In the conversion of an existing installation with steam heated dryers to one in accord with the principles of the present invention, heating unit 106 is substituted for the boiler of the conventional system; and the various supply and return lines which connect the heating unit and dryers into a closed circulation replace the steam supply and condensate recovery and return systems as well as the make-up water supply arrangement, etc.

Liquid may also be diverted from main supply conduit 110 through branch conduits 118 to the felt dryers 52 (not shown in FIG. 3). From these the spent liquid is discharged through branch return conduits 120 into main return conduit 116.

Valves 122 in return conduits 120 control the flow of liquid through the felt dryers and, therefore, the surface temperatures of these dryers. Valves 122 may be manually controlled, or they may be controlled automatically by a sensor responsive to the moisture contents of the felts, for example.

As indicated above, one of the advantages of the present invention, not attainable in an installation employing steam heated dryers, is that the different groups of dryers can be maintained at different temperatures. For example, the three paper dryers 42-*a* in the first dryer group or zone 44-*a* will typically be operated at temperatures comparable to those of the dryers in a conventional installation. Otherwise, moisture may be evaporated at such a high rate as to blow the paper away from the dryers.

The remaining paper dryers 42 will, however, typically be operated at temperatures as much as 250° F. or more above the practical maximum of steam heated, rotary dryers. The result is a significant increase in efficiency and a corresponding reduction in cost.

Independent control over the different groups or zones is furnished by a recirculation conduit 124 connected between the branch return and supply conduits 115 and 112 in each zone and a three-way diverting valve 126 discharging into conduits 115 and 124.

A pump 128 in each dryer group or zone 44*a–d* circulates the liquid through the dryers and conduits in that zone.

Valve 126 is controlled by a conventional temperature controller 132. The controller has a sensor (not shown) that responds to the temperature of the liquid circulated to the paper dryers by pump 128.

If the dryers in a particular group become too hot, the controller 132 for that group adjusts valve 126 to divert relatively cool liquid through recirculation conduit 124 to the inlet side of pump 128. Recirculation continues until the temperature of the dryers drops to the wanted level. Then, temperature controller 132 repositions valve 126, decreasing the flow of liquid through recirculation conduit 124 and increasing the flow through branch return conduit 115. As a result, increased quantities of more highly heated heat transfer liquid are pumped from main supply conduit 110 through branch supply conduit 112 and into the dryers.

As indicated above, the novel dryer section 22 of the present invention will typically include a sweat roll 56 which may be of the same construction as the paper dryers 42. Typically, water from any convenient source will be employed as an operating liquid for the sweat dryer. As shown in FIG. 3, the water can be simply supplied to the sweat dryer through conduits 136 and then discharged from the sweat roll through conduits 138.

Alternatively, the same heat transfer liquid employed to operate the paper and felt dryers may be used as the operating liquid for the sweat dryer. In this case, valve 144 in the water supply line is closed as is valve 146 in a bypass conduit 148 between main heat transfer liquid supply and return lines 110 and 116. Valve 150 in conduit 110 is then opened, permitting the heat transfer liquid to flow through a conventional heat exchanger 152 of the shell and tube or other appropriate type to reduce the temperature of the heat transfer liquid. From the cooler the liquid flows sequentially through conduit 136, the sweat roll, and conduit 138 into main return conduit 116.

Figure 4:
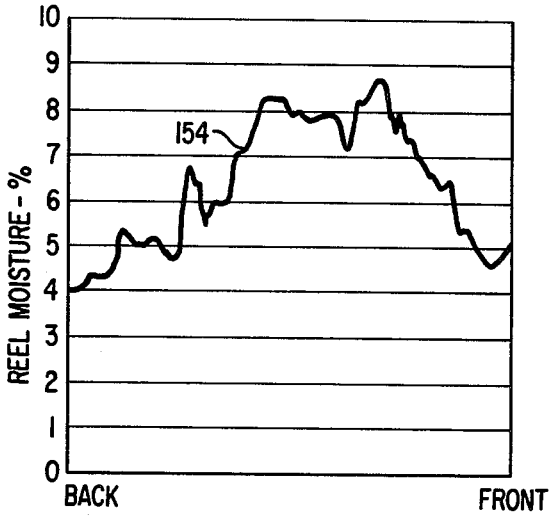
FIG. 4 is an actual and typical reel moisture profile for newsprint.

It was pointed out above that a disadvantage of drying paper with steam heated dryers is the non-uniform reel moisture profile which results. Curve 154 in FIG. 4 is an actual and typical moisture profile taken from a sample of newsprint. The moisture content of this sample in the cross machine direction varied by more than 200 percent from the minimum level.

Figure 5:
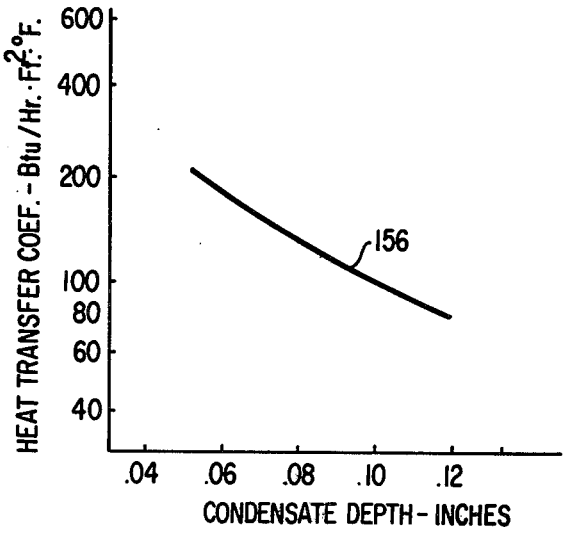
FIG. 5 is a graph showing the extremely adverse effect which condensate has on performance in a conventional, steam heated dryer.
Figure 6:
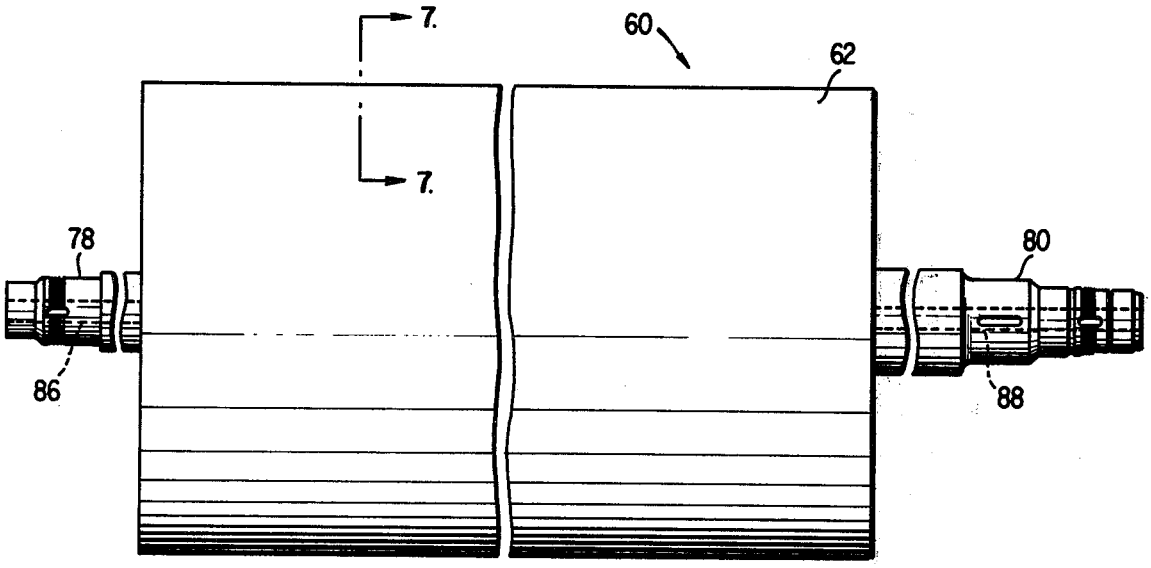
FIG. 6 is a side view of an equitemp dryer constructed in accord with the principles of the present invention.

That this lack of uniformity can result from a variation in condensate thickness is apparent from curve 156 in FIG. 5. It shows that, in one steam heated dryer operating at 2600 feet per minute, an increase in the thickness of the condensate film from 0.05 to 0.12 inch reduced the heat transfer coefficient of the film/shell composite from over 200 to about 80 BTU per hour per square foot per degree Fahrenheit. Because there is no condensate film in dryers constructed and operated in accord with the principles of the present invention, this source of irregular moisture profile is not present.

Figure 12:
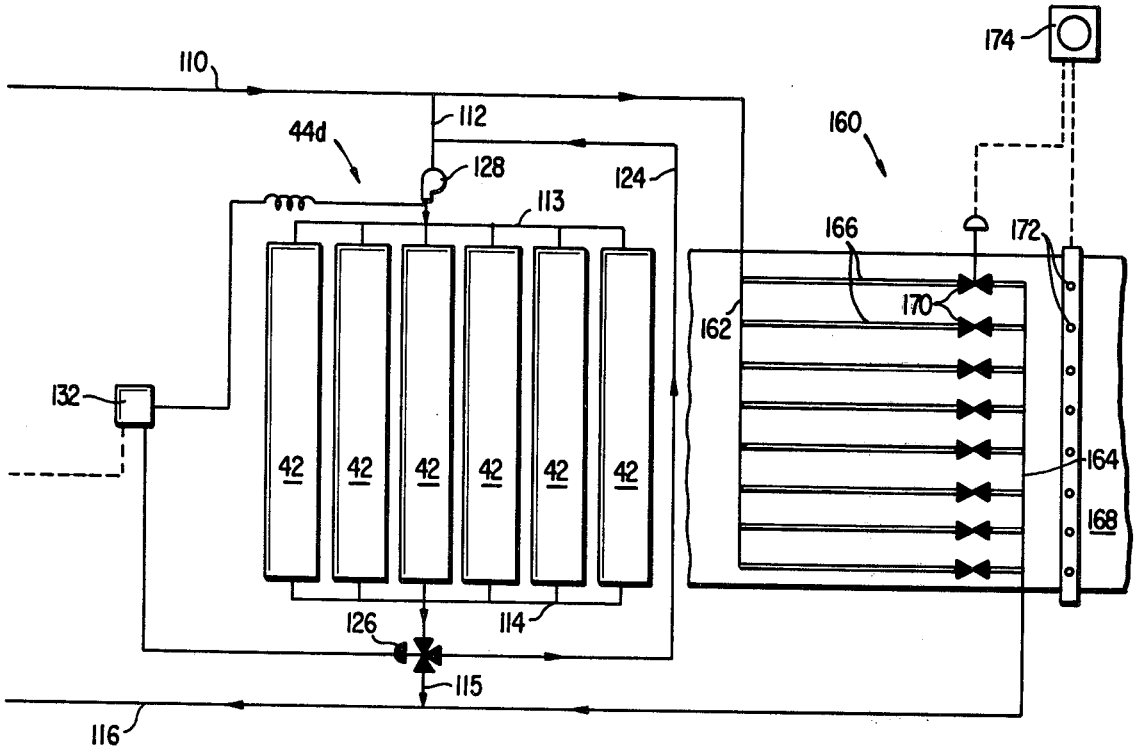
FIG. 12 is a view similar to FIG. 3 showing a drying section equipped with a radiant type, moisture profile correction unit in accord with the principles of the present invention.

Furthermore, when wanted, a further increase in uniformity of the reel moisture content can be readily provided by employing a radiant moisture profile correction unit as discussed above. One such unit in accord with the principles of the present invention is shown in FIG. 12 and identified by reference character 160.

This unit includes an inlet header 162, an outlet header 164, and tubular radiant heaters 166. The inlet and outlet headers span the web of material 168 being dried and are connected to the supply and return conduits 110 and 116 for the heat transfer liquid.

Radiant heaters 166 extend in the direction of travel of web 168 and communicate with the inlet and outlet headers. They are spaced to direct the energy they emit against transverse sections of the web of equal width.

Valves 170 control the flows of heat transfer liquid through, and therefore, the temperatures reached by the different heaters. This permits the rate of evolution of volatiles from those parts of the web opposite different heaters to be independently adjusted and variations in the reel moisture profile of the web to be reduced.

Valves 170 may be regulated manually or automatically. One suitable automatic control system, shown schematically in FIG. 12, includes a moisture sensor 172 for each radiant heater. One suitable sensing arrangement is described in TAPPI, February 1969, pages 276–278. Another suitable system is described in PLYWOOD AND PANEL, March 1969, page 11.

Sensors 172 are connected to a conventional programmed controller 174 which in turn is connected to valves 170. The controller adjusts the valves and proportions the flow through each heater 166 to the moisture content in the region of the web opposite the heater.

Moisture profile correction by the use of radiant heaters is discussed in more detail in my above-identified U.S. Pat. Nos. 3,791,049 and 3,793,741 which are hereby incorporated herein and which may be referred to by the reader, if desired.

Figure 13:
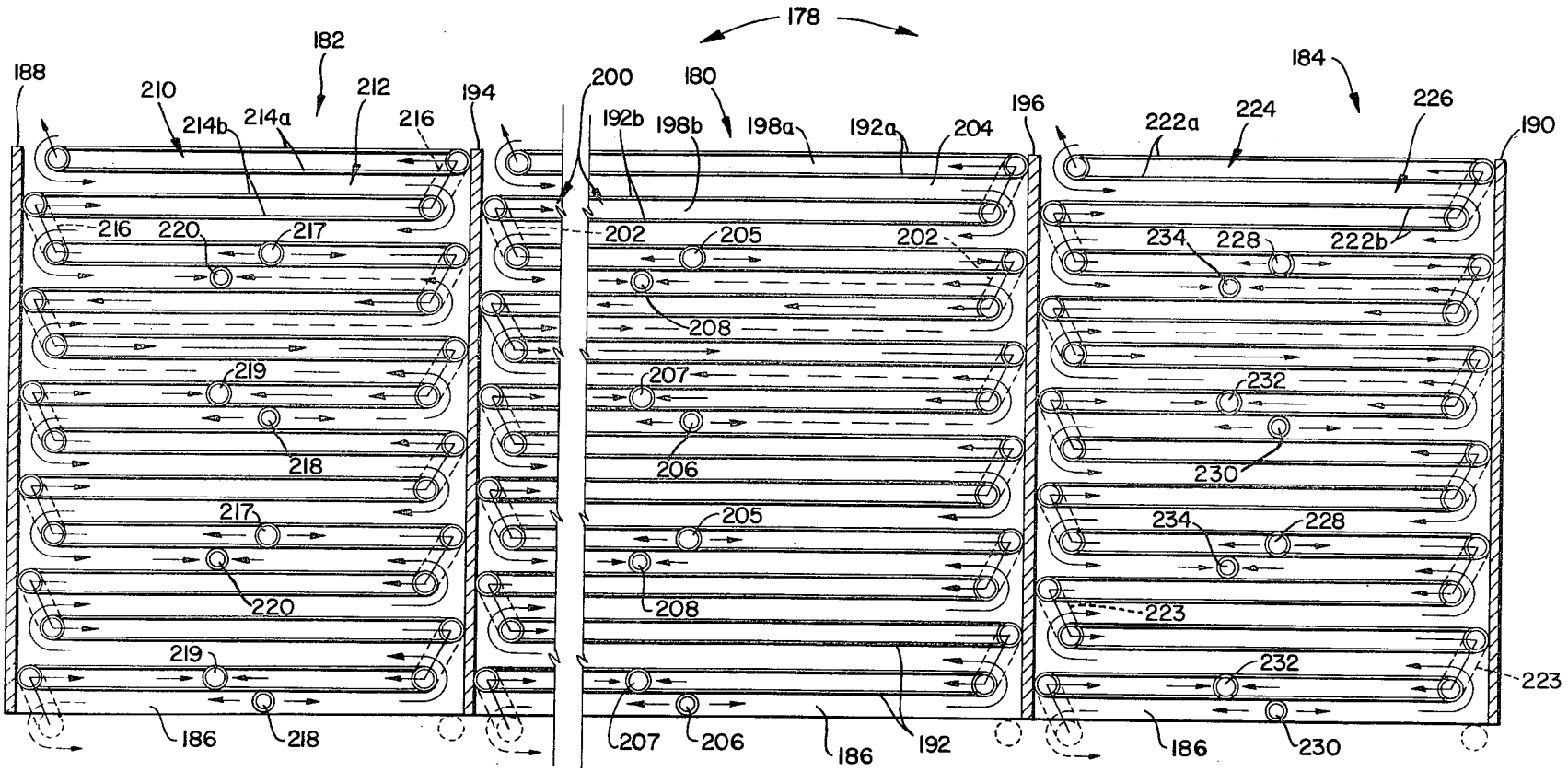
FIG. 13 is a view similar to FIG. 9 of another equitemp dryer construction in accord with the principles of the present invention.

It was pointed out above that liquid heated dryers in accord with the principles of the present invention also have the advantage that, unlike steam heated rotary dryers, the surface temperature of the dryer can be varied across its span and that this is accomplished by providing two or more separate circulation systems in the dryer for the heat transfer liquid. A dryer of this character is shown in developed form in FIG. 13 and identified by reference character 178.

This particular dryer, which is designed to operate in a manner that will compensate for variations in the moisture content of the air adjacent its surface and thereby eliminate irregularities in moisture profile attributable to the varying moisture content, has three, independent, heat transfer liquid circulation systems 180, 182, and 184. The central flow system 180 spans approximately one-half the dryer and each of the two systems 182 and 184 approximately one-fourth its length. These proportions may vary from application-to-application as may the number of circulation systems.

In general, dryer 178 is of the same construction as the equitemp dryer 60 described previously. It includes an inner shell 186, an outer shell (not shown), and heads 188 and 190.

The fluid flow channels of central circulation system 180 are formed between the inner and outer shells by longitudinally extending partitions 192. Although shown as simple, rectangularly sectioned members, the longitudinally extending partitions 192 may be of the laterally deflectable, springlike character described above.

Pairs 192*a* and 192*b* of partitions extend alternately from annular partitions 194 and 196 at opposite ends of the central, liquid circulating system and terminate short of the partition at the opposite end of the central system. These partitions are dimensioned to span the gap between the inner and outer shells of dryer 178.

The longitudinally extending spaces 198*a* and 198*b* between partition pairs 192*a* and 192*b* are connected into a sinuous flow channel 200 by U-shaped fluid transfer tubes 202 at the free ends of the partition pairs. A second, internested, also sinuous flow channel 204 is formed by the spaces between the partition pairs as terminated by the transfer tubes. The heat transfer fluid is introduced into flow channels 200 and 204 through inlets 205 and 206 and discharged through outlets 207 and 208. As shown by the arrows in FIG. 13, this provides true counterflow of the liquid in the two flow channels, minimizing variations in the surface temperature of that portion of the dryer spanned by circulation system 180.

Details of the novel counterflow circulation system just described may be found in previously issued U.S. Pat. No. 3,177,932 which is hereby incorporated by reference and which may be referred to by the reader, if desired.

Also described in that patent is a system for conducting the heat transfer liquid from the exterior of the dryer to inlets 205 and 206 and for returning it to the dryer exterior from outlets 207 and 208. As a satisfactory system has heretofore been described and as the details of this system are not part of the present invention, it will not be described further herein.

Heat transfer liquid circulation system 182 extends from the left-hand head 188 of dryer 178 to partition 194. This system has two internested, sinuous flow channels 210 and 212 formed by longitudinally extending partition pairs 214*a* and 214*b* and transfer tubes 216 all connected in the same manner as the corresponding components in circulation system 180.

The heat transfer liquid is supplied to channels 210 and 212 through ports 217 and 218 and exits therefrom through discharge ports 219 and 220. The heat transfer liquid also circulates in counterflow relationship through the channels of this circulation system.

Circulation system 184, which extends between partition 196 and head 190, is constructed in the same manner as circulation systems 180 and 182. In system 184 the longitudinal partition pairs and transfer tubes are identified by reference characters 222*a* and *b* and 223, respectively. These components divide the annular space between partition 196 and head 190 into sinuous, internested flow channels 224 and 226 supplied with heat transfer liquid through ports 228 and 230. After circulating in counterflow relationship through the flow channels, the liquid exits therefrom through discharge ports 232 and 234.

The arrangement employed to supply liquid of different temperatures and/or at different rates to the circulation system of a dryer as shown in FIG. 13 is, again, not part of the present invention and, therefore, not to be described in detail herein. In general, however, such control may be afforded by using recirculation systems as described above and shown in FIG. 3. For example, one such system may be employed in each zone of the dryer shown in that Figure to supply liquid to the central circulation systems 180 of the dryers in the zone and a second such system to control the temperature of the liquid flowing through the outer or end zones 182 and 184 of those dryers.

Steam at the pressures used in the papermaking industry (up to 125 psi) is an inefficient heating medium. As a consequence, from 1.2 to 2.5 pounds of steam are required to evaporate one pound of water in a modern installation of conventional character. An industrywide average of 1.5 pounds of water is evaporated to produce one pound of paper. Thus, from 2.25 to 3.75 pounds of steam is required to make one pound of paper. This translates directly into an energy input of 2190 to 2650 BTU per pound of paper that must be supplied from coal, oil, or other fuel.

In contrast, if attention is paid to properly insulating the circulation system, etc. in an installation as described above, at least 90 percent of the BTUs in the heat transfer liquid is available to the water in the web being dried. Consequently, as few as 1850 BTUs may be required to heat and evaporate the water from one pound of paper.

Thus, application of the principles of the present invention can result in fuel savings of 15–49 percent as the liquid heaters I contemplate are as efficient as modern steam generators.

Papermaking at rates of 1000 tons per day is by no means unknown. In a plant of this magnitude and at the $13.50 per ton fuel cost discussed above, the reduction in fuel consumption I am able to realize can result in savings of $2000–6600 per day.

It will be appreciated by those skilled in the relevant arts that there are many extensions and variations of the basic principles enunciated above. For example, the use of pocket ventilation has been promoted as a solution to the moisture profile problem (see, for example, the Lee article identifiedabove). If desired, advantage can readily be taken of pocket ventilation as dryer sections of the character I have invented are physically compatible with existing pocket ventilation systems.

Still other extensions and variations will readily occur to those to whom this specification is directed. To the extent these are not excluded, therefore, they are fully intended to be embraced within the scope of the appended claims.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed and desired to be secured by Letters Patent is:

1. A method of drying continuous webs of paper and the like comprising the steps of: mounting a plurality of rotary dryers in spaced apart relationship for rotation about parallel axes; circulating a high boiling point, non-aqueous heat transfer liquid through said dryers in liquid form to increase the external surface temperatures thereof; effecting a movement of the web to be dried through the zone in which the dryers are disposed; and bringing said web into contact with successive ones of said dryers as it moves through said zone to thereby effect an evaporation of volatiles from said web, there being a sweat roll spaced from the last of the rotary dryers for cooling the dry product and said method including the step of altering the surface temperature of the sweat roll by circulating the same heat transfer liquid as is circulated through the rotary dryers through a heat exchanger to reduce its temperature and then circulating said heat exchange liquid through said sweat roll, the dryers and the sweat rolls being simultaneously operated as aforesaid.

2. An installation for drying a continuous web of paper or the like comprising: a series of dryers, each having an elongated, cylindrical outer shell; means mounting said dryers in spaced apart relationship for rotation about parallel axes; means for wrapping the web to be dried around successive ones of said dryers and for keeping the web in contact with the dryers to thereby promote the transfer of heat from the dryers to the web being dried; means for circulating a liquid heat transfer medium through each said dryer and into heat transfer relationship with the outer shell thereof to heat said shell and thereby furnish the energy for evaporating moisture from the web being dried; a sweat roll in series with the last of the rotary dryers; and means for circulating a heat transfer liquid through said sweat roll to keep its surface temperature low enough to extract heat from the dried product, the means for circulating the heat transfer liquid through the sweat roll comprising means for first cooling a part of the same liquid heat transfer medium as is supplied to the dryers and then circulating said liquid heat transfer medium to the sweat roll.

* * * * *